United States Patent [19]

Appleman

[11] 4,042,043

[45] Aug. 16, 1977

[54] PORTABLE EARTH BORING MACHINE

[75] Inventor: William S. Appleman, Ashland, Ohio

[73] Assignee: The Richmond Manufacturing Company, Ashland, Ohio

[21] Appl. No.: 592,791

[22] Filed: July 2, 1975

Related U.S. Application Data

[63] Continuation of Ser. No. 455,254, March 27, 1974, abandoned.

[51] Int. Cl.[2] ..... E21D 9/02; E02D 7/28

[52] U.S. Cl. ..... 173/152; 60/489; 175/122; 175/171

[58] Field of Search ..... 175/122, 170, 171; 173/152, 154, 43; 60/486, 489; 408/130

[56] References Cited

U.S. PATENT DOCUMENTS

| | | | |
|---|---|---|---|
| 3,220,494 | 11/1965 | Cannon | 173/152 X |
| 3,464,502 | 9/1969 | Ageton | 173/152 X |
| 3,587,755 | 6/1971 | Slusher | 175/122 X |
| 3,869,003 | 3/1975 | Yamada et al. | 175/171 |
| 3,910,358 | 10/1975 | Martinek | 173/152 |

*Primary Examiner*—Ernest R. Purser
*Assistant Examiner*—William F. Pate, III
*Attorney, Agent, or Firm*—Palmer Fultz

[57] ABSTRACT

A portable earth boring machine for the horizontal boring of shafts and the insertion of pipeline casing sections in installations where excavation from the surface is undesirable. The machine is characterized by frame means adapted for movement along a track means, which frame means supports an engine which drives an earth boring auger as well as casing pusher apparatus for pushing casing sections into the earth fill as the boring operation progresses. The machine is further characterized by a fluid actuated pusher cylinder means for advancing the auger into the earth fill and associated automatic auger feed control means for automatically maintaining a constant fluid flow rate to said pushing cylinder means under variations in resistance to auger penetration of said earth fill during a boring operation.

2 Claims, 4 Drawing Figures

FIG. 2-A.

PORTABLE EARTH BORING MACHINE

REFERENCE TO CO-PENDING APPLICATION

This application is a continuation of my-copending application, Ser. No. 455,254, filed Mar. 27, 1974 now abandoned.

BACKGROUND OF THE INVENTION

This invention relates to portable earth boring machines and more particularly to a machine adapted for horizontal boring of shafts for the insertion of pipelines at installations where excavation from the surface is undersirable.

SUMMARY OF THE INVENTION

In general, the machine of the present invention comprises a base means that includes spaced track members which are disposed in a trench adjacent the hill to be bored. The machine further includes a frame means mounted for movement along the track means and such carriage supports a power train for rotating connected sections of auger shafts which comprise a progressively extendable boring auger. The frame means further supports a pusher ring for driving sections of casings into the bored hole and an associated pushing cylinder means is provided for advancing and retracting the frame means and pusher ring along the track means.

With machines of this general type problems have been encountered in the function of advancing and retracting the above mentioned frame means along its track for the purpose of advancing the retracting the boring auger into various types of earth fill which may comprise anything from hard rock to soft earth.

It has been the practice in the art to control the feed of the auger by "jogging" or the manual on-off operation of a hydraulic valve so as to increase or decrease the flow of hydraulic fluid to the pushing cylinders that feed the earth boring auger. This prior method of manual feed control has precluded the realization of constant feed control under conditions where variations in the resistance to auger penetration are encountered, for example variations in soil conditions and the presence of rock deposits.

It is therefore a primary aspect of the present invention to provide a novel automatic auger feed control means for automatically maintaining a constant fluid flow rate to said pushing cyliner means under variations in resistance to auger penetration of said earth fill during a boring operation.

In addition, problems have been present in the pushing of the casing sections in that it is desirable to at some times advance the pusher ring and frame means at relatively fast speeds when the friction against the casing sections is low or when it is desired to rapidly retract the frame means along the carriage under low load conditions. Under such conditions, prior machines of this type have been encumbered by pushing cylinder apparatus and associated control means which were incapable of both relatively slow and relatively rapid actuation.

In accordance with the present invention the earth boring machine is provided with a novel hydraulic control means for the pushing cylinder apparatus which includes a novel volumetic fluid flow controller that can be set by the operator to either a "low flow" position, or a "high flow" position depending on the operational speed requirements during any particular portions of the boring or casing pushing operations.

As another aspect of the present invention, the control means is provided with a multiple pump source of pressurized fluid and associated control means which enable the operator selectively to deliver pressurized oil to the pushing cylinders either from one or both of the pumps.

As still another aspect of the present invention, the novel control means is provided with a maximum high pressure relief valve means which prevents the operator from at anytime overloading the components of the fluid circuit.

It is therefore a primary object of the present invention to provide a novel earth boring machine that includes an automatic auger feed control means for maintaining a constant rate of auger feed notwithstanding variations in the resistance to auger penetration encountered in the earth fill.

It is another object of the present invention to provide an earth boring machine with a novel control system that includes both a low volumetric flow stage and a high volumetric flow stage for the selective operation of the pushing cylinders at either relatively slow or relatively fast speeds.

It is another object of the present invention to provide a boring machine with a control system of the type described that is operated by two relatively small and inexpensive pumps yet which has the capacity for relatively rapid actuation of the pushing cylinders.

It is still another object of the present invention to provide a boring machine with a control system of the type described which includes a safety means for preventing the operator from anytime overloading the hydraulic system.

Further objects and advantages of the present invention will be apparent from the following description, reference being had to the accompanying drawings wherein a preferred form of embodiment of the invention is clearly shown.

BRIEF DESCRIPTION OF THE DRAWINGS

FIG. 2-A is a perspective view of a control station for the machine of the present invention.

DESCRIPTION OF THE PREFERRED EMBODIMENT

Figure 1:
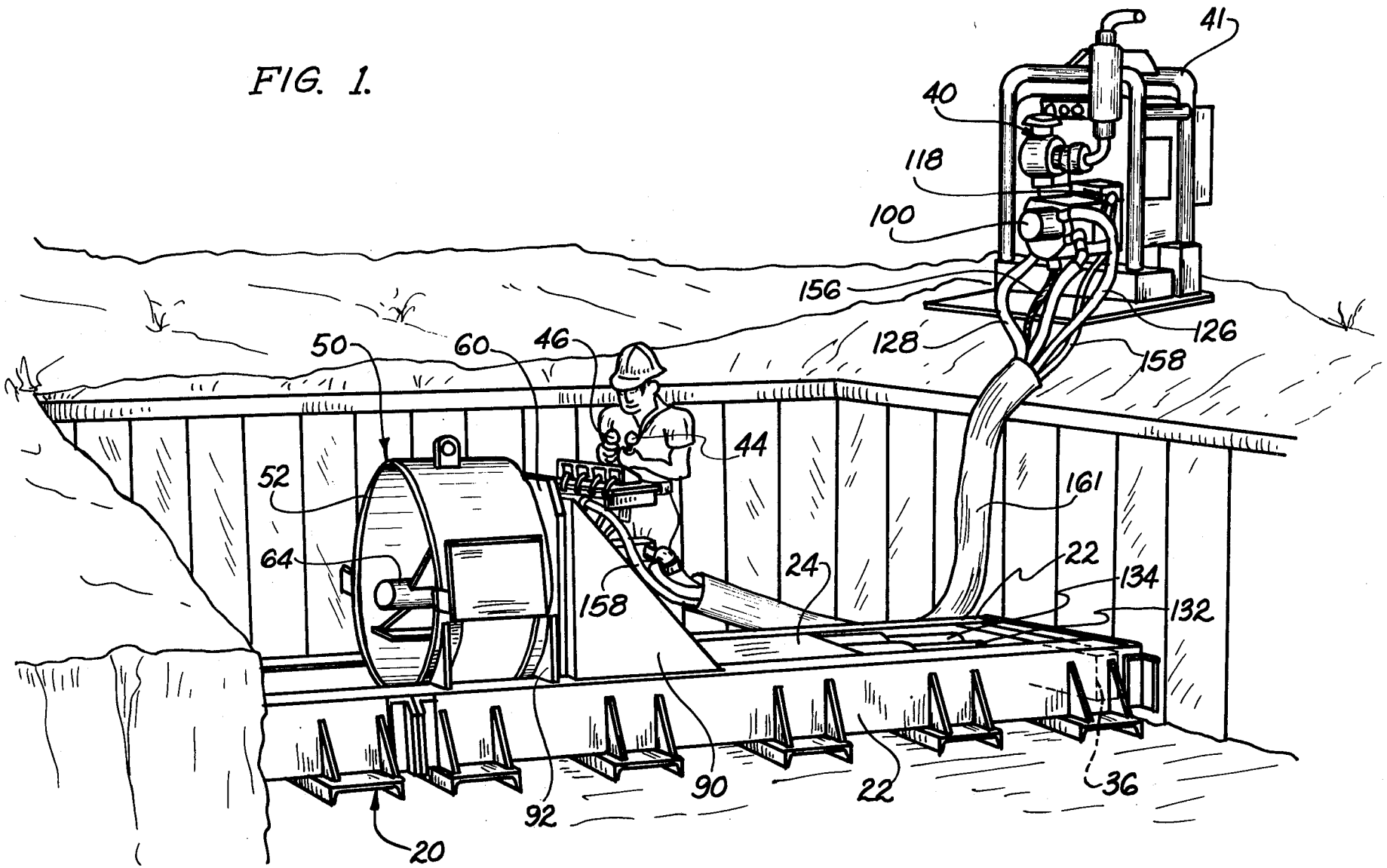
FIG. 1 is a perspective view of a boring machine constructed in accordance with the present invention and showing the main frame portion of such machine disposed in a trench in a boring position with the removable engine frame portion positioned outside the trench.
Figure 2:
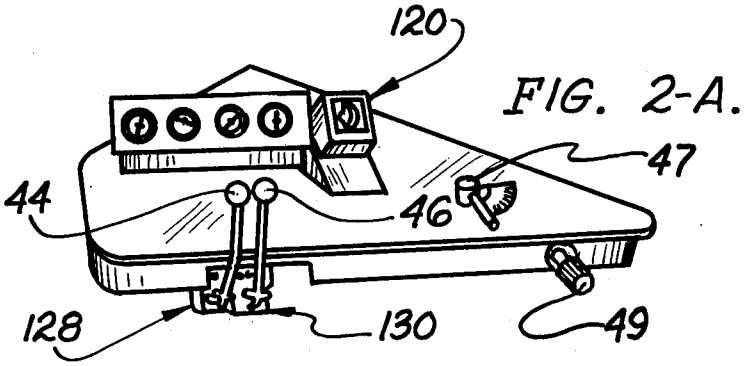
FIG. 2 is a side elevational view of the boring machine of FIG. 1.
Figure 2:
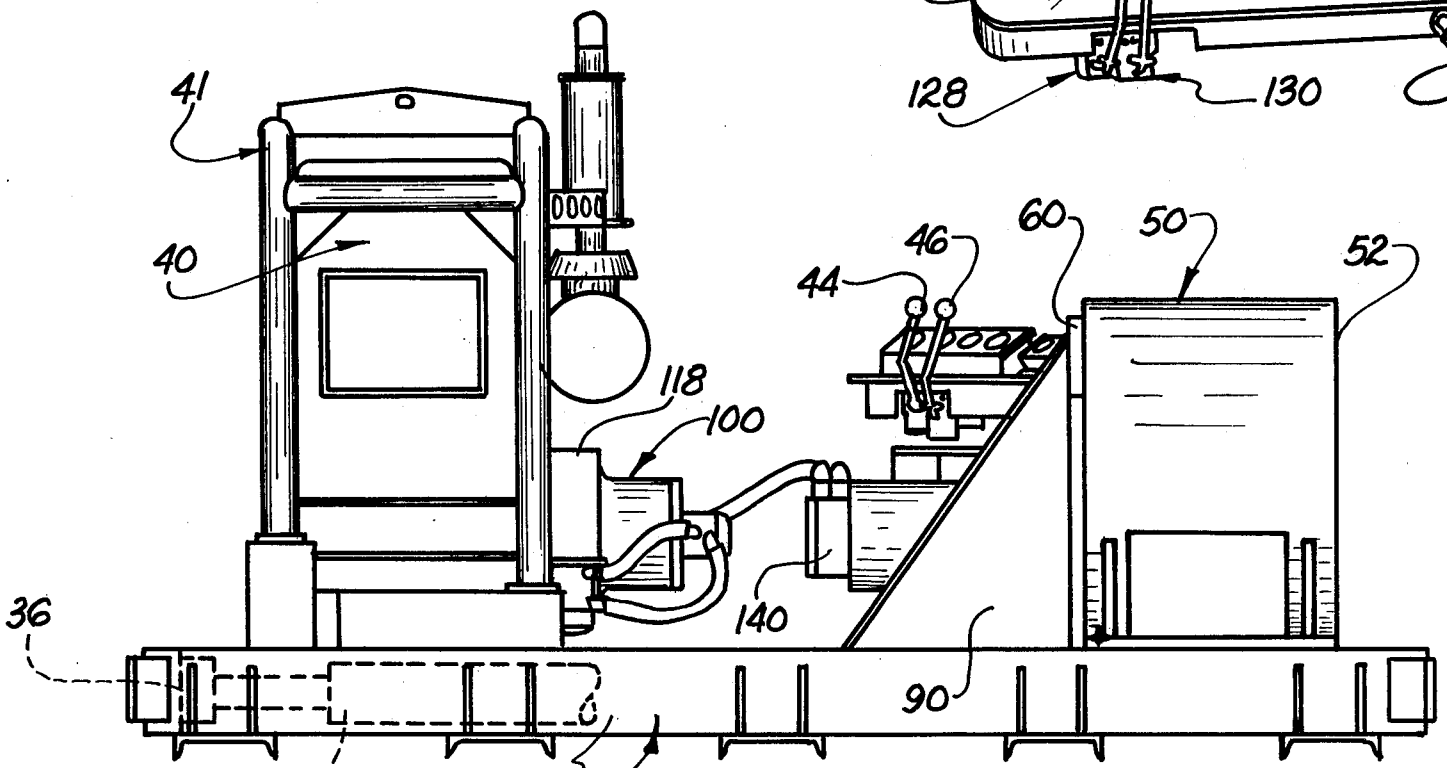

Referring in detail to the drawings, FIGS. 1 and 2 illustrate the complete horizontal earth boring machine of the present invention which comprises a base means indicated generally at 20. Such base means includes spaced longitudinally extending track means 22 which support a carriage means indicated generally at 24.

The carriage means 24 is advanced and retracted along track 22 by hydraulic power cylinders, a portion of which is seen at 132,134 in FIG. 1. With such power cylinders being operatively connected between a power cylinder base 36 and the carriage means 24.

Details of typical power cylinders such as 132 and 134 and power cylinder base 36 are disclosed and described in detail in the application of Albert R. Richmond, Ser. No. 867,816 filed Oct. 20, 1969, now U.S. Pat. No. 3,612,195 issued Nov. 12, 1971.

Figure 3:
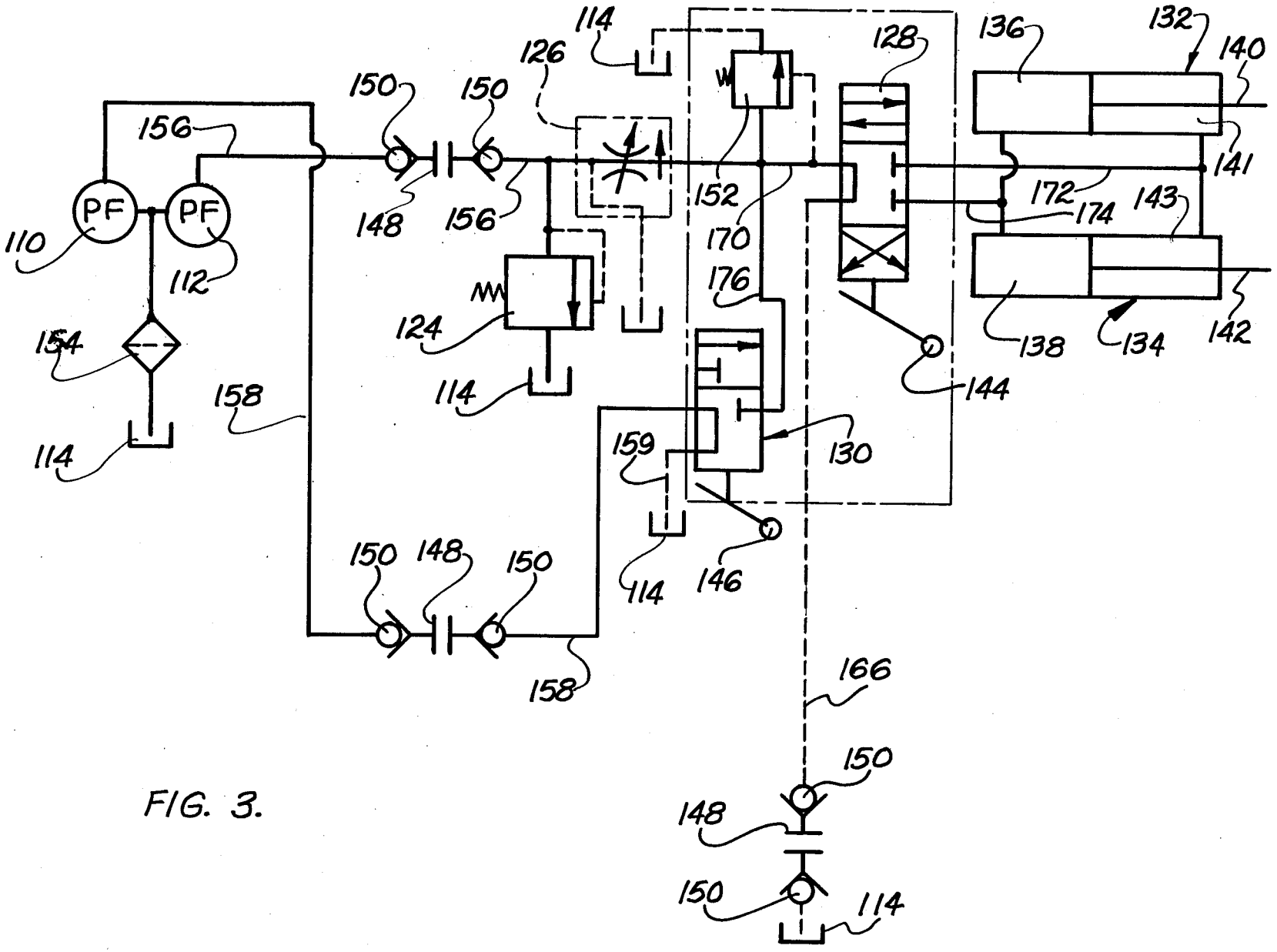
FIG. 3 is a diagrammatic view of a hydraulic circuit comprising the control means for the machine of the present invention.

It will be further seen that pressurized fluid for actuating power cylinders 132 and 134 is provided by a fluid power system, FIG. 3, including pumps 110 and 112 driven by an engine 40. The fluid power circuit further includes control valve mechanisms 144 and 146 and conduits 172 and 174 such that when the control valve mechanisms are actuated the pushing cylinders 134–132 are extended or retracted so as to move carriage 24 forwardly or rearwardly along the track means 22.

Referring again to FIG. 1, the boring machine further includes a pusher ring 50 including a front annular surface 52 for engaging the sections of pipe casing for pushing such sections into the bored hole. Such pusher ring 50 includes a thrust plate 60 mounted on the carriage means with such thrust plate 60 serving as a mount for a thrust bearing, not illustrated, for the auger connecting shaft 64. The mechanism comprising the thrust plate 60, the thrust bearing assembly mounted thereon, and the back-up plates 90 transmit the thrust from the auger connecting shaft 64 to the carriage means 24 and thereby isolate the power train from the thrust.

A typical auger construction for connection with the machine of the present invention is disclosed and described in detail in the application of Albert R. Richmond, Ser. No. 85,614 filed October 30, 1970, now U.S. Pat. No. 3,696,734 issued Sept. 26, 1972.

Reference is next made to the diagram of the hydraulic circuit for the pushing cylinders, FIG. 3, which includes pump means comprising two fixed displacement pumps 110 and 112. Fluid from pump 112 flows through line 156 and quick disconnect coupling 150 to a pressure compensated flow control valve 126. Such flow control valve 126 functions to automatically maintain a constant volumetric flow of pressurized fluid from pump 112 to a pushing cylinder means comprising two pushing cylinders 132 and 134. That is, the fluid flow rate is maintained constant, with a resulting constant auger feed rate into the earth fill notwithstanding variations in resistance to auger penetration encountered in the earth fill during a boring operation.

It should further be mentioned that flow control valve 126 is manually adjustable to permit infinite variations in flow rate between zero and maximum such that the operator can preselect the appropriate auger feed rate for the particular earth conditions as well as for the particular boring head being used on the particular job.

In this connection it should be pointed out that certain soil conditions require, for most efficient boring, certain types of boring heads such as diamond tipped rock heads, whereas other soil conditions require heads designed for penetrating earth, and these various boring heads operate most efficiently at certain auger feed rates.

Immediately upstream of flow control valve 126 is an adjustable pressure relief valve 124 for releasing excess pressurized fluid back to tank 114. Fluid leaving the pressure compensated flow control valve 126 passes via line 170 to a four-way valve 128 which is used to directionally control the pushing cylinders indicated generally at 132 and 134. This four-way valve is manually manipulated by a control lever 144 such that when lever 144 is in an "extension" position fluid from the valve is delivered to the base chambers 136 and 138 of the cylinders via line 174 and drained from the rod chambers 141 and 143. The rods 140 and 142 are thereby extended creating the pushing pressures. When it is desired to retract the rod ends 140 and 142 of pushing cylinders 132 and 134 then four-way valve actuating lever 144 is shifted to a "retract" position and pressurized fluid is thereby delivered via lines 170 and 172 to the rod chambers 141 and 143 of the pushing cylinders 132 and 134 and fluid is drained from base chambers 136 and 138 via lines 174 and 166 to tank 114.

The previously mentioned adjustable pressure relief valve 124 is provided in line 156 in order to selectively control the desired pressures for the particular type of earth being drilled. For example, in the drilling of solid granite which is encountered in New England and similar terrain it is necessary to prevent the application of excessive pressures otherwise the boring head or drill can easily be damaged. At other times with softer terrain it is desired to have higher pressures. Moreover, during casing pushing operations the string of casing sections increases in length, more and more pressure is required to move the lengthened string against earth imposed friction without exceding the permissible force on the forward casing section.

Reference is next made to the function of the other fixed displacement pump 110 in FIG. 3 where it will be seen that the pressurized fluid is delivered via conduit 158 and quick disconnect coupling 148 to a volumetric flow varying controller in the form of a valve 130 which is provided with a manual actuator or control lever 146.

In normal boring operations valve 130 is left in a neutral position wherein fluid from pump 110 circulates continuously back to tank 114 via line 158, valve 130 and line 159.

Under certain boring conditions or under fast retract operation of the pushing cylinders 132 and 134 there is a demand for a high volumetric flow of oil and the second pump 110 is connected into the load circuit and the fluid therefrom is delivered to the pushing cylinders by action of valve 130 to connect the previously mentioned line 158 to the inlet of directional control valve 128 via lines 176 and 170, with valve 130 being closed to tank return line 159.

It will be seen from FIG. 3 that in such high volumetric flow conditions the total flow of oil from both the pumps is still controlled by the directional control valve 128 in the manner previously described.

Referring again to FIG. 3 it will be noted that a preset maximum pressure relief valve 152 is connected ahead of the four-way valve 128 at line 170 and functions to limit the maximum fluid pressure which can at any time be imposed on the system.

It should be mentioned that the lines 156, 158 and 166 are preferably provided with quick disconnect couplings 148–150 such that the remote control loom 161 of flexible conduits and wires can be readily installed for the remote control operating position of FIG. 1. When the removable engine frame portion 41 is positioned on the main frame means, as seen in FIG. 2, the fluid conduit and wire connections are short and the remote control loom 161 is not needed.

While the forms of embodiments of the present invention as herein disclosed constitute preferred forms, it is to be understood that other forms might be adopted.

I claim:

1. An earth boring apparatus for drilling holes and pushing casing sections therein, said apparatus comprising, in combination, track means; casing pusher means on said track means for engaging the rear end of a casing section; pushing cylinder means for moving said casing pusher means along said track means and including an extension chamber and a retraction chamber; auxiliary frame means for disposition at a location remote from said main frame means; an engine mounted on said auxiliary frame means; pump means driven by said engine for delivering pressurized fluid to said pushing cylinder means; conduit means connecting said pushing cylinder means with said pump means; control means including a directional valve means in the flow of pressurized fluid from said pump means to said pushing cylinder means, said directional valve means including a "closed center" position for isolating both of said chambers from said flow, an "extension" position for pressurizing said extension chamber and draining said retraction chamber, and a "retract" position for pressurizing said retraction chamber and draining said extension chamber; volumetric flow varying controller in said control means and including a "low flow" position for delivering a relatively low volumetric flow from said pump means to said pushing cylinder means and a "high flow" position for delivering a relatively high volumetric flow from said pump means to said pushing cylinder means; a first manual actuator for said control means for selectively positioning said directional valve means in said "center", "extension", and "retraction" positions; a second manual actuator for said control means for selectively positioning said volumetric flow varying valve means in said "low flow" and "high flow" positions and variable flow control means in the flow of pressurized fluid from said pump means to said directional controller, said pump means including a first pump for delivering a first flow of pressurized fluid to said directional valve means, and a second pump for delivering a second flow of pressurized fluid to said volumetric flow varying controller.

2. An earth boring apparatus for drilling holes and pushing casing sections therein, said apparatus comprising, in combination, track means; casing pusher means on said track means for engaging the rear end of a casing section; pushing cylinder means for moving said casing pusher means along said track means and including an extension chamber and a retraction chamber; auxiliary frame means for disposition at a location remote from said main frame means; an engine mounted on said auxiliary frame means; pump means driven by said engine for delivering pressurized fluid to said pushing cylinder means; conduit means connecting said pushing cylinder means with said pump means; control means including a directional valve means in the flow of pressurized fluid from said pump means to said pushing cylinder means, said directional valve means including a closed center position for isolating both of said chambers from said flow, an "extension" position for pressurizing said extension chamber and draining said retraction chamber, and a retract position for pressurizing said retraction chamber and draining said extension chamber; volumetric flow varying controller in said control means and including a low flow position for delivering a relatively low volumetric flow from said pump means to said pushing cylinder means a high flow position for delivering a relatively high volumetric flow from said pump means to said pushing cylinder means; a first manual actuator for said control means for selectively positioning said directional valve means in said center, extension, and retraction positions; a second manual actuator for said control means for selectively positioning said volumetric flow varying valve means in said low flow and high flow positions; and variable flow control means in the flow of pressurized fluid from said pump means to said directional controller, said control means including a maximum pressure relief valve means in the flow of pressurized fluid to said ppushing cylinder means.

* * * * *